US007554463B2

(12) United States Patent
Ulius-Sabel et al.

(10) Patent No.: US 7,554,463 B2
(45) Date of Patent: Jun. 30, 2009

(54) APPLIANCE INFORMATION COMMUNICATION SYSTEM

(75) Inventors: Sara B. Ulius-Sabel, Berrien Springs, MI (US); Eric A. Hill, Holland, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 207 days.

(21) Appl. No.: 11/379,167

(22) Filed: Apr. 18, 2006

(65) Prior Publication Data

US 2007/0241938 A1 Oct. 18, 2007

(51) Int. Cl.
*H03K 17/00* (2006.01)

(52) U.S. Cl. ..... 341/22; 341/176; 340/825.69

(58) Field of Classification Search ..... 341/176, 341/22, 23; 340/825.69
See application file for complete search history.

(56) References Cited

U.S. PATENT DOCUMENTS

| | | | | |
|---|---|---|---|---|
| 4,009,598 | A * | 3/1977 | Bernard et al. | 68/12.18 |
| 4,341,197 | A | 7/1982 | Butts | |
| 4,454,501 | A | 6/1984 | Butts | |
| 4,772,769 | A | 9/1988 | Shumate | |
| 4,903,530 | A | 2/1990 | Hull | |
| 4,992,704 | A | 2/1991 | Stinson | |
| 5,321,602 | A | 6/1994 | Francisco | |
| 5,408,060 | A * | 4/1995 | Muurinen | 200/314 |
| 5,453,731 | A | 9/1995 | Beyer | |
| 5,464,955 | A | 11/1995 | Cole | |
| 5,619,182 | A | 4/1997 | Robb | |
| 5,698,826 | A | 12/1997 | Cracraft et al. | |
| 5,736,942 | A | 4/1998 | Randolph | |
| 6,054,981 | A | 4/2000 | Kimoto et al. | |
| 7,250,898 | B2 * | 7/2007 | Higginson | 341/176 |
| 2004/0171410 | A1 | 9/2004 | Deeds | |
| 2005/0078027 | A1 | 4/2005 | Philipp | |

FOREIGN PATENT DOCUMENTS

| | | | |
|---|---|---|---|
| DE | 3235752 | A1 | 3/1984 |
| DE | 3722857 | A1 | 1/1989 |
| DE | 3149702 | C1 | 9/1989 |
| DE | 4038531 | A1 | 6/1992 |
| EP | 0382279 | A2 | 8/1990 |
| EP | 0508563 | A1 | 10/1992 |

* cited by examiner

*Primary Examiner*—Brian A Zimmerman
*Assistant Examiner*—Hung Q Dang
(74) *Attorney, Agent, or Firm*—Clifton Green; Michael D. Lafrenz

(57) ABSTRACT

Communicating operational information to a user of an appliance regarding the operational mode of the appliance and the options available for a selected operational mode and the options selected.

30 Claims, 8 Drawing Sheets

APPLIANCE INFORMATION COMMUNICATION SYSTEM

BACKGROUND OF THE INVENTION

1. Field of the Invention

The invention relates to communicating information to the user of an appliance, and more specifically to a user interface for household appliance through which information may be communicated.

2. Description of the Related Art

Household appliances, such as clothes washers and dryers, utilize user interfaces to enable a user of the appliance to control the operation of the appliance. The user interface typically includes a controller, which may comprise a microprocessor, memory, and associated circuitry, and a panel adapted to accommodate selection devices such as knobs, switches, push buttons, and the like. The selection devices are utilized to select operating modes, such as predefined wash and dry cycles, and options which can be selected for specific operating modes. Illustrative washing modes commonly include normal wash, heavy duty, delicate, for example. Illustrative drying modes commonly include normal dry, permanent press, air dry, for example. Illustrative options for clothes washers commonly include water temperature, spin speed, soil level, extra rinse, pre-wash, and the like. Illustrative options for dryers commonly include drying temperature, drying time, dryness level, and the like.

In a typical household washer and dryer, the available options may vary depending on the selected mode. For example, if the operating mode selected for a clothes washer is a delicate washing cycle, the available water temperature options may be limited to "cold" and "warm," with "hot" unavailable for selection. Some current clothes washers may indicate which of the options has been selected, e.g. "cold," but not that "warm" is also available and that "hot" is unavailable. Thus, a user wishing to change the water temperature for the selected operating mode must select, in turn, each of the temperature options to determine which of the temperature options is available and can be selected. Other current washers may indicate all available options but stop indicating the available options upon the selection of one option by the user. Thus, if a user wants to change the selected option, they no longer have an indication of which options are available and must go from memory or by trial and error. In some cases they must restart the cycle. Furthermore, once the start of the selected operating mode has been initiated, current clothes washers and dryers do not inform the user whether further changes to the options are available.

SUMMARY OF THE INVENTION

The invention relates to communicating operational information to a user of an appliance by indicating options available for selection by the user for a particular operating mode, indicating which of the available options is selected by the user, distinguishing between selected available option and non-selected available options, and continuing to indicate the non-selected available options subsequent to the selection of the selected available option.

DESCRIPTION OF AN EMBODIMENT OF THE INVENTION

Figure 1:
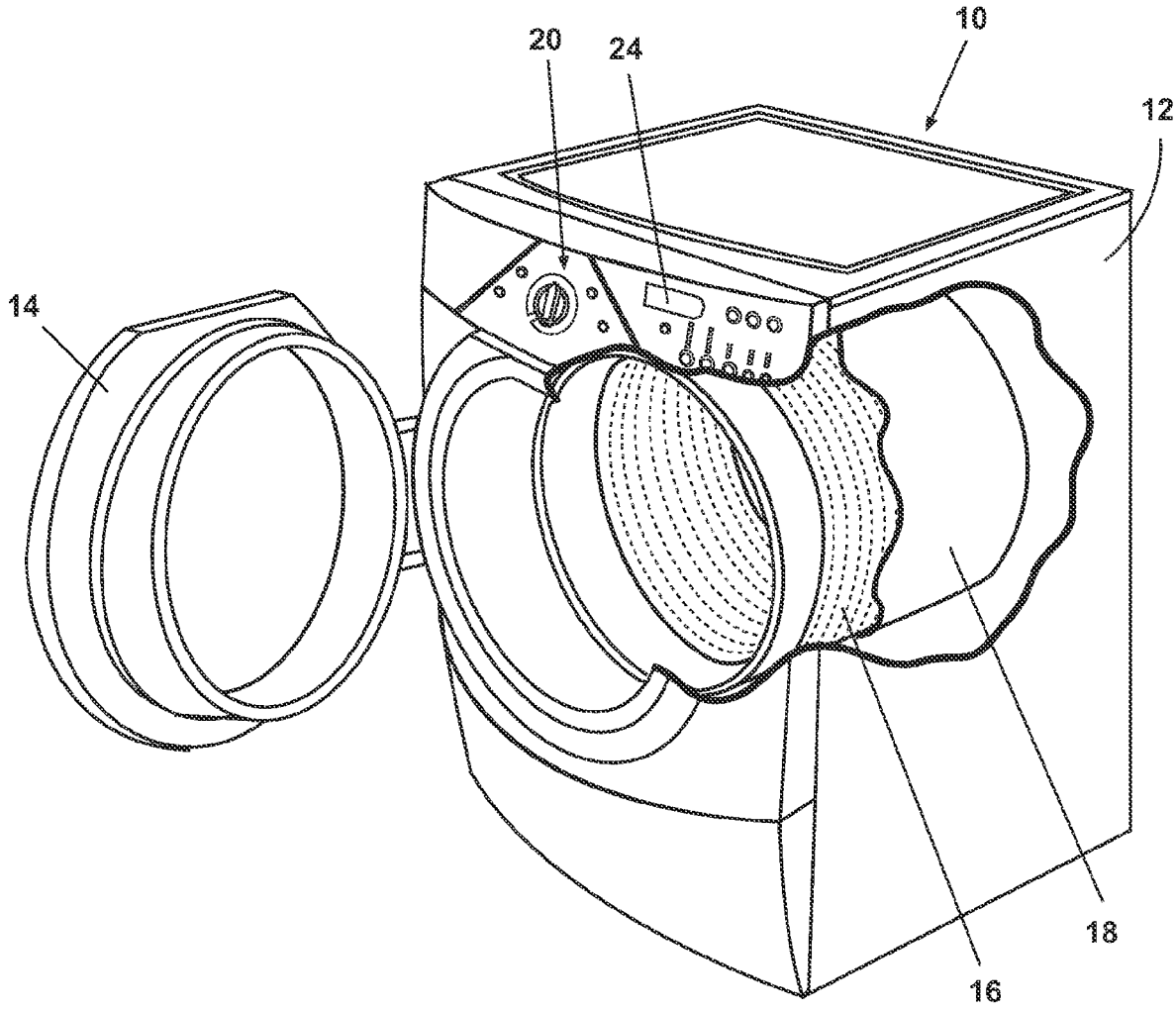
FIG. 1 is a perspective, partially cut-away view of an automatic clothes washer having a first embodiment of the invention illustrated as a control panel.

Referring now to FIG. 1, a first embodiment of the invention is illustrated as a clothes washer 10 having a cabinet 12, an access door 14 for enabling a user to access a perforated basket 16 rotatably mounted within an imperforate drum 18 housed in the cabinet 12, and adapted in a well known manner for the washing of clothes and other fabric items. The clothes washer 10 may be provided with a control panel 20 having a display 24 to enable a user of the appliance to control the operation of the appliance such as by selecting an operating mode from among a plurality of operating modes, and selecting options from among a plurality of options available for the selected operating mode The display 24 may provide information to the user to assist the user in the selection and operation of the clothes washer controls, including error messages.

Figure 2:
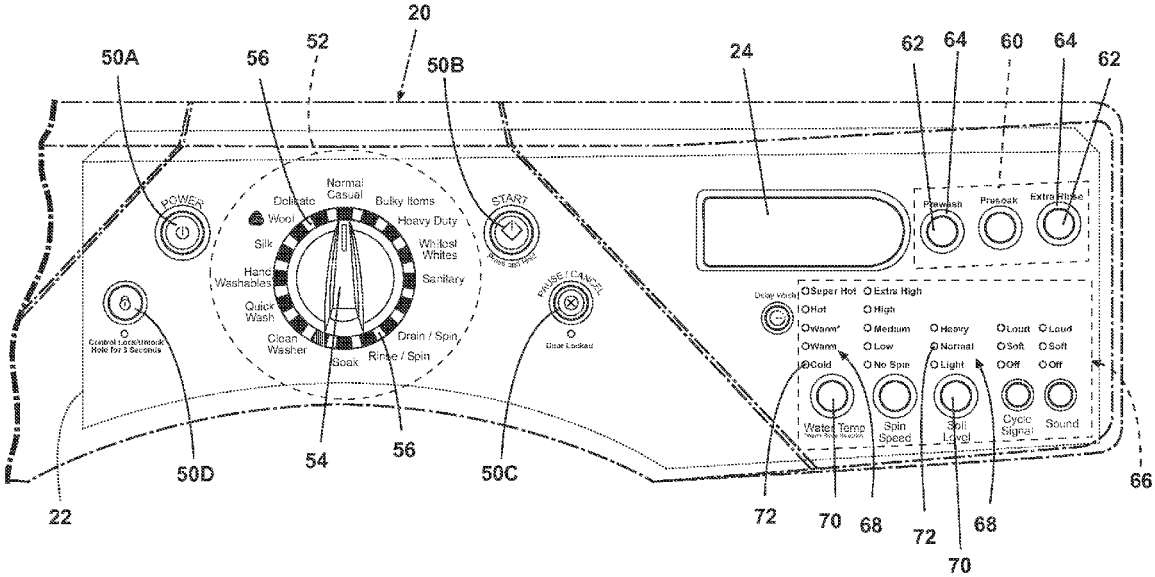
FIG. 2 is an enlarged view of the control panel illustrated in FIG. 1 showing mode and option arrays.

The control panel 20 is illustrated in FIG. 2. A controller 22 may be associated with the control panel 20 and may extend behind the control panel 20 in operable registry with various controls and indicators. The controller 22 may be a generally well known microprocessor-based controller, which may be in the form of a circuit board, having memory, displays, circuitry, switches, and the like.

The control panel 20 has a power switch 50 for turning the washer on and off. The panel 20 may be divided into a mode array 52 and an options array, which may have both a single-variable options array 64, and a multi-variable options array 66. The mode array 52 includes a variety of selectable washing modes or cycles, such as normal wash, bulky items, quick wash, delicates, rinse and spin, and the like. A mode may be selected by a mode selector 54, which is illustrated in FIG. 2 as a rotatable dial. Alternatively, individual modes may be selected by depressing a button or switch associated with that mode. Each mode has an associated mode illumination source 56 which may be illuminated when the associated mode has been selected by the rotatable dial or switch 54, and may be otherwise darkened. Thus, if the normal wash mode is selected, the illumination source 56 associated with the normal wash mode may be illuminated. Otherwise, if another mode is selected, the illumination source 56 associated with the normal wash mode may be darkened.

The mode array 52 may have related operational inputs such as the power switch 50A, start switch 50B, pause/cancel switch 50C, and a control lock 50D. These related operational inputs may be used to effect the progress of the selected mode.

The single-variable options array 60 may encompass several options that may be selected for a given operational mode. The illustrated options are a pre-wash cycle, a presoak cycle, an extra rinse cycle, and the like, which may be selected by the user. The types of options are not limiting on the invention and are provided for illustration.

Each option may be selectable through an options switch 62, such as a push-button switch, which has an associated visual indicator illustrated in the form of an illumination source 64. The illumination source 64 is illustrated in FIG. 2 as encircling the switch 62. The type of indicator is not limiting on the invention even though a visual indicator in the form of an illumination source is illustrated. Thus, other configurations, for the illumination source may be used, such as a separate, adjacent illumination source.

The multi-variable options array 66 encompasses several options which may be further organized into parameter sub-arrays 68. Each parameter sub-array 68 may be provided with an associated options switch 70, such as a push-button switch. Each parameter sub-array 68 may encompass several options, each of which may be associated with an options illumination source 72, which are logically or functionally related. Thus, for example, the parameter sub-arrays 68 may include water temperature, spin speed, soil level, cycle signal, and sound. The options available for the water temperature parameter sub-array 68 may range from cold to super hot. The options available for the cycle signal parameter sub-array 68 may range from loud to off. Depressing the options switch 70 may enable a user to scroll through the available options and select a preferred option.

While the type of indicator for any of the modes or options is not limiting on the invention, the embodiment is illustrated with a visual indicator in the form of an illumination source. The illumination sources 56, 64, 72 may comprise incandescent light bulbs, light emitting diodes (LEDs), fiber-optic devices, and the like, and may be operably connected to the controller 22 for control of the illumination state associated with a selected mode or option. Multi-color LEDs may be used to conveniently implement the invention. Multi-color LEDs can conveniently produce multiple illumination states based on the emitted color and/or the intensity of the light, which may include both on and off states of the LED, regardless of the emitted color.

Whatever illumination source may be used, it is contemplated that at least either the color and/or intensity of the illumination source may be used to define different illumination states, which are used as different indications. As intensity is used in this description, it includes light output levels from full off to full on, and it also includes varying the light output, such blinking or strobing, at a constant or varying light output.

The operation of the washer may be begun by the user pressing the power switch 50A to supply power to the appliance. The user then rotates the dial 54 to select the desired operating mode. The illumination source 56 for the selected mode changes illumination states from off to on. In response to the selected operating mode, the controller 22 changes the illumination states of the illumination source for the options. For those options that are available to be selected for the selected operational mode, the controller illuminates the corresponding illumination source in a first illumination state to indicate to the user that the options are available for selection. When the user selects one or more of the available options, the controller changes the illumination state of the corresponding illumination source for the selected available option(s) to a second illumination state to distinguish the selected available options from the non-selected available options. Alternatively, the controller 22 may select default options for one or more parameter sub-arrays. These default options may be illuminated in the second illumination state to indicate that the option is available and selected. For those options that are not available for the selected operational mode, the controller may set the illumination state of the corresponding illumination source to a third illumination state to distinguish the available options from the non-available options, regardless of whether the available options are selected. One possible implementation may be that the third illumination state corresponds to the corresponding illumination source being turned off and the first and second illumination states correspond to illumination in different colors.

Once the user has selected from the available options, the user presses the start switch 50B and the controller begins implementing the selected operational mode. The controller maintains the available options, both selected and non-selected, in their current illumination state until the operational mode passes the point where the available option may still be selected, at which time the available option becomes unavailable and the controller changes the illumination state to the third illumination state.

If at any time during the implementation of the operational mode the user selects a previously non-selected available option, the controller may change the corresponding illumination state from the first illumination state to the second illumination state. If the user unselects a previously selected option, the controller changes the illumination state from the second illumination state to the first illumination state.

With this methodology, the user interface continuously communicates to the user the availability of the various options and the selected status of the available options. Specific examples will now be described to aid in the further understanding of the invention.

For the single variable options array 60, each of the available options may be indicated by the controller 22 illuminating the illumination source 64 in a first illumination state. If one of the options is selected, the illumination source 64 may then be illuminated in a second illumination state. If one of the options is not available, the illumination source may be illuminated in a third illumination state. One possible implementation is that the first and second illumination states may be different colors, such as amber and red, with the third illumination state being off or no illumination.

For the multiple-variable options array 66, each of the available parameter sub-arrays 68 may be indicated by the illumination of the options switch 70 in a first illumination state. Each option associated with a particular parameter sub-array 68, for example the temperature options in the water temperature parameter sub-array, may be indicated by illumination of the option illumination source 72 for each option in one of three illumination states. An option that is available and not selected may be illuminated in a first illumination state, which may be a first color such as amber. An option that is available and selected may be illuminated in a second illumination state, which may be a second color such as green. An option that is unavailable may be illuminated in a third illumination state, which may be darkened or a third color such as red. A parameter sub-array 68 that is not available may be indicated by the illumination of the options switch 70 in a second illumination state, such as a darkened or off state. The options illumination sources 72 for each of the options in the parameter sub-array 68 may also be indicated by the illumination of the options illumination sources 72 in the third illumination state, such as a darkened or off state.

An example of the information communication system may now be described with reference to FIGS. 3 and 4. The multi-variable options illumination sources 72 may take one of several states depending upon the availability and selection of an option. For example, referring to FIG. 3, the water temperature parameter sub-array 68 is illustrated as encompassing five different water temperatures: super hot, hot, warm with warm rinse, warm, and cold. These water temperatures may be available options for one or more modes. Thus, the selection of the normal wash mode may enable the selection of one of several water temperatures, for example, hot, warm with warm rinse, warm, and cold. Each of these wash temperatures may be available for selection until the wash cycle is started. The availability of these wash temperatures may be indicated by a first illumination state, such as a blinking or strobing illumination, or a first color, such as amber. The wash temperature that may be selected may be indicated by a second illumination state, such as a continuous illumination, or a second color, such as green. A wash temperature that may be unavailable for the particular mode selected may be indicated by a third illumination state, such as a darkened indicator or a third color, such as red.

Figure 3:
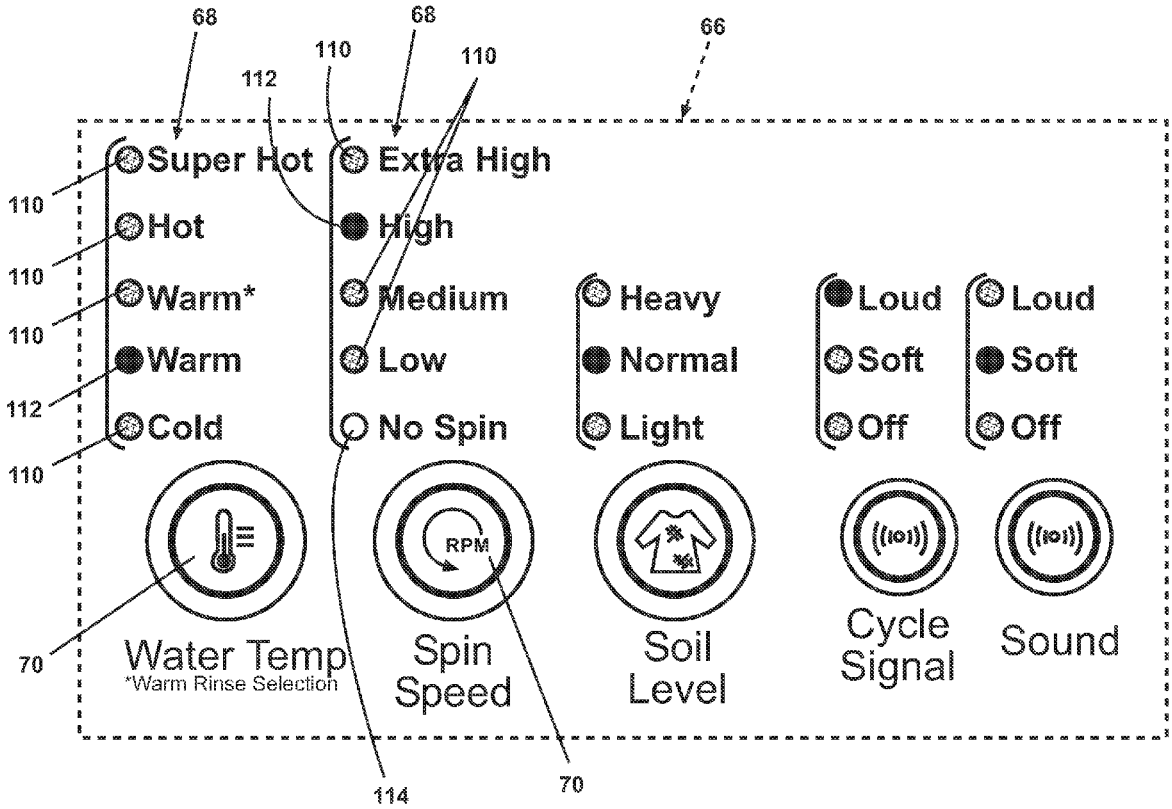
FIG. 3 is an enlarged view of a portion of the control panel illustrated in FIG. 1 showing available selected, available non-selected, and unavailable options for a plurality of parameter sub-arrays in a first configuration.

Thus, as illustrated in FIG. 3, the water temperature parameter sub-array 68 includes non-selected available indicators 110 illuminated in a first illumination state which indicate that the associated water temperatures super hot, hot, warm with warm rinse, and cold are available for the selected mode, but have not, in fact, been selected. The water temperature parameter sub-array 68 also includes the selected available indicator 112 which indicates that the warm water temperature may be available for the selected mode and has, in fact, been selected.

The spin speed parameter sub-array 68 includes non-selected available indicators 110 which indicate that the associated spin speeds extra high, medium, and low are available for the selected mode, but have not, in fact, been selected. A non-selected unavailable indicator 114 associated with no spin may not be illuminated, indicating that, for the mode selected, a no spin option may be unavailable. The available selected indicator 112 indicates that the high speed has been selected.

Figure 4:
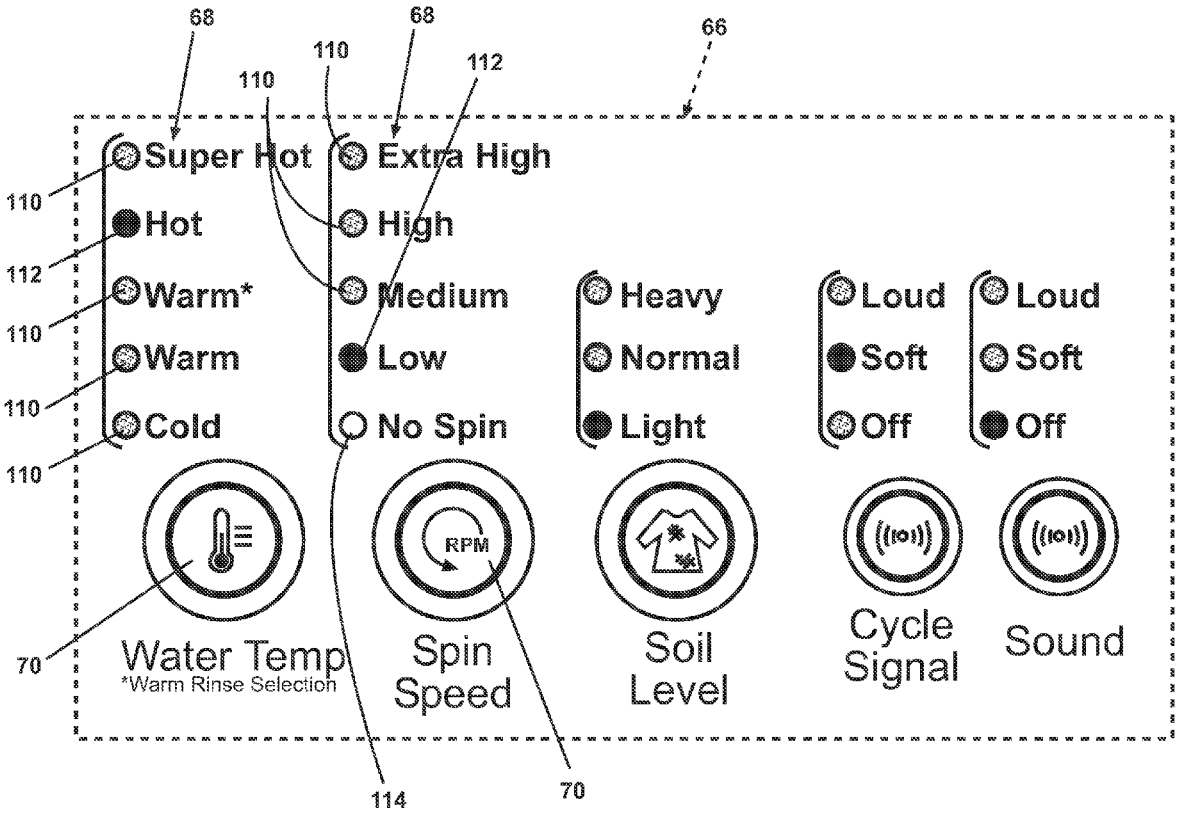
FIG. 4 is an enlarged view similar to FIG. 3 showing available selected, available non-selected, and unavailable options in a second configuration.

Referring now to FIG. 4, if a different water temperature, such as hot, is selected, the indicator associated with the hot temperature may be illuminated 112 to indicate that hot is available and selected. The remaining water temperatures super hot, warm with warm rinse, warm, and cold are illuminated 110 to indicate that these temperatures are available but non-selected. Similarly, if a different spin speed, such as low, may be selected, the indicator associated with the low spin speed may be illuminated 112 to indicate that low may be available and selected. The extra high, high, and medium spin speeds may be illuminated 110 to indicate that these spin speeds are available and non-selected. The indicator may be not illuminated 114 to indicate that this option may be unavailable.

The options associated with a particular parameter sub-array 68, such as spin speed, may remain available for selection until a predetermined point in the wash cycle, such as the initiation of the spin portion of the wash cycle. The multi-variable options illumination sources 72 may remain illuminated until the predetermined point in the wash cycle has been reached to indicate that the options remain selectable. Thus, for example, if a high spin speed has been selected 112, as illustrated in FIG. 3, the available non-selected spin speeds extra high, medium, and low may remain illuminated until the predetermined point in the wash cycle to indicate that these speeds remain available and non-selected. After the predetermined point has been reached, however, the available non-selected spin speed illumination sources 110 may be darkened or illuminated in some alternative state to indicate that these options are unavailable and non-selected. The illumination of the available selected spin speed 112 may remain unchanged.

Alternatively, certain options may not be selectable while the appliance is operating, but may be selected when the appliance is in an abnormally stopped state, such as when the operational mode is paused or canceled. In these instances, the available non-selected options may become unavailable when the operating mode is initiated by the user activating the start switch. The available and selected options would remain illuminated. If the user were to interrupt the current operating mode, e.g. by activating a pause switch on the washer or dryer or opening the dryer door, available and unselected options may become illuminated again to indicate that they are available and unselected.

The use of illumination sources capable of illumination in different states may provide additional information to a user to enable a user to more efficiently select available options and more effectively control the operation of the appliance. The use of illumination sources that indicate with a first illumination state that an option may be available but non-selected and with a second illumination state that an option may be unavailable may enable a user to quickly select an option desired without the necessity of selecting in a trial-and-error approach options that are unavailable. Furthermore, the continuation of the illumination of illumination sources in a particular illumination state until the point in the operating cycle of the appliance at which the option can no longer be selected may enable the user to more effectively determine the best options for the use of the appliance while such options may still be selected. The use of visual indicators capable of illumination in several different illumination states may provide a user with valuable information in a very short period of time.

Figure 5:
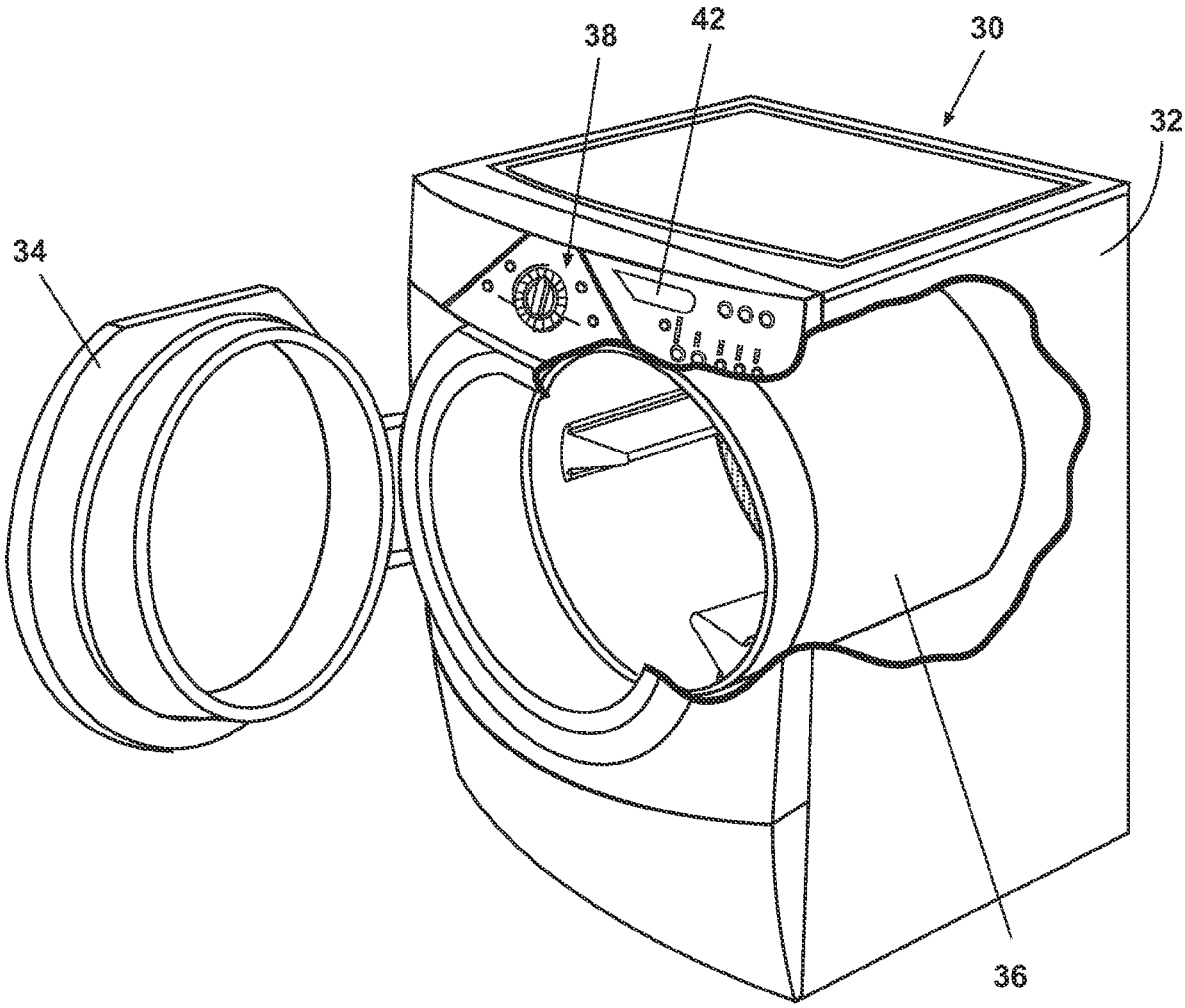
FIG. 5 is a perspective, partially cut-away view of an automatic clothes dryer having a second embodiment of the invention illustrated as a control panel.

Referring now to FIG. 5, a second embodiment of the invention is illustrated as a clothes dryer 30 having a cabinet 32, and access door 34 for enabling a user to access a dryer drum 36 housed in the cabinet 32, and adapted in a well known manner for the drying of clothes and other fabric items. The clothes dryer 30 may be provided with a control panel 38 having a display 42.

Figure 6:
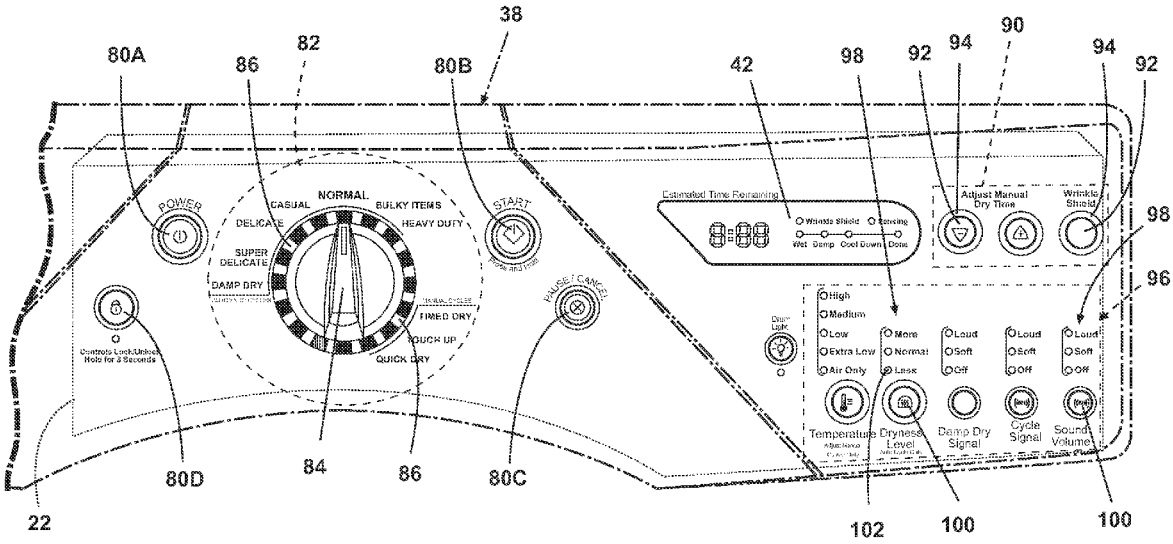
FIG. 6 is an enlarged view of the control panel illustrated in FIG. 5 showing mode and option arrays.

The control panel 38 is illustrated in FIG. 6. A controller 40 may be associated with the control panel 38 and extends behind the control panel 38 in operable registry with various controls and indicators. The controller 40 may be a generally well known microprocessor-based controller, which may be in the form of a circuit board, having memory, displays, circuitry, switches, and the like.

The control panel 38 has a power switch 80 for turning the dryer on and off. The panel 38 may be divided into a mode array 82 and an options array, which may have both a single-variable options array 90, and a multi-variable options array 96. The mode array 82 includes a variety of selectable drying modes or cycles, such as normal, heavy duty, damp dry, timed dry, and the like. A mode may be selected by a mode selector 84, which is illustrated in FIG. 6 as a rotatable dial. Alternatively, individual modes may be selected by depressing a button or switch associated with that mode. Each mode has an associated mode illumination source 86 which may be illuminated when the associated mode has been selected by the rotatable dial or switch 84, and may be otherwise darkened. Thus, if the normal dry mode may be selected, the illumination source 86 associated with the normal dry mode may be illuminated. Otherwise, if another mode may be selected, the illumination source 86 associated with the normal dry mode may be darkened.

The mode array 82 may have related operational inputs such as the power switch 80A, start switch 80B, pause/cancel switch 80C, and a control lock 80D. These related operational inputs may be used to affect the progress of the selected mode.

The single-variable options array 90 may encompass several options that may be selected for a given operational mode. The illustrated options are a wrinkle shield, the option of increasing or decreasing the manual dry time, and the like, which may be selected by the user. The types of options are not limiting on the invention and are provided for illustration.

Each option may be selectable through an options switch 92, such as a push-button switch, which has an associated visual indicator in the form of an illumination source 94. The illumination source 94 is illustrated in FIG. 6 as encircling the switch 92. The type of indicator is not limiting on the invention even though a visual indicator in the form of an illumination source is illustrated. Thus, other configurations, for the illumination source may be used, such as a separate, adjacent illumination source.

The multi-variable options array 96 encompasses several options which may be further organized into parameter sub-arrays 98. Each parameter sub-array 98 may be provided with an associated options switch 100, such as a push-button switch. Each parameter sub-array 98 encompasses several options, each of which may be associated with an options illumination source 102, which are logically or functionally related. Thus, for example, the parameter sub-arrays 98 include dry temperature, dryness level, damp dry signal, cycle signal, and sound volume. The options available for the dry temperature parameter sub-array 98 may range from high to air only. The options available for the dryness level may include more, normal, and less. Depressing the options switch 100 may enable a user to scroll through the available options and select a preferred option.

As with the first embodiment, for the second embodiment, the type of indicator for any of the modes or options is not limiting on the invention, the embodiment is illustrated with a visual indicator in the form of an illumination source. The second embodiment uses the same type of illumination sources as the first embodiment for the illumination sources 86, 94, 102.

The operation of the dryer may be begun by the user pressing the power switch 80A to supply power to the appliance. The user then rotates the dial 84 to select the desired operating mode. The illumination source 86 for the selected mode changes illumination states from off to on. In response to the selected operating mode, the controller 40 changes the illumination states of the illumination source for the options. For those options that are available to be selected for the selected operational mode, the controller illuminates the corresponding illumination source in a first illumination state to indicate to the user that the options are available for selection. When the user selects one or more of the available options, the controller changes the illumination state of the corresponding illumination source for the selected available option(s) to a second illumination state to distinguish the selected available options from the non-selected available options. Alternatively, the controller 40 may select default options for one or more parameter sub-arrays. These default options may be illuminated in the second illumination state to indicate that the option is available and selected. For those options that are not available for the selected operational mode, the controller may be set the illumination state of the corresponding illumination source to a third illumination state to distinguish the available options from the non-available options, regardless of whether the available options are selected. One possible implementation may be that the third illumination state corresponds to the corresponding illumination source being turned off and the first and second illumination states correspond to illumination in different colors.

Once the user has selected from the available options, the user presses the start switch 80B and the controller begins implementing the selected operational mode. The controller maintains the available options, both selected and non-selected, in their current illumination state until the operational mode passes the point where the available option may still be selected at which time the available option becomes unavailable and the controller changes the illumination state to the third illumination state.

If at any time during the implementation of the operational mode the user selects a previously non-selected available option, the controller may be change the corresponding illumination state from the first illumination state to the second illumination state. If the user unselects a previously selected option, the controller changes the illumination state from the second illumination state to the first illumination state.

With this methodology, the user interface continuously communicates to the user the availability of the various options and the selected status of the available options. Specific examples may be now be described to aid in the further understanding of the invention.

For the single variable options array 90, each of the available options may be indicated by the controller 40 illuminating the illumination source 94 in a first illumination state. If one of the options is selected, the illumination source 94 may be then illuminated in a second illumination state. If one of the options is not available, the illumination source may be illuminated in a third illumination state. One possible implementation may be that the first and second illumination states may be different colors, such as amber and red, with the third illumination state being off or no illumination.

For the multiple-variable options array 96, each of the available parameter sub-arrays 98 may be indicated by the illumination of the options switch 100 in a first illumination state. Each option associated with a particular parameter sub-array 98, for example the temperature options in the dryer temperature parameter sub-array, may be indicated by illumination of the option illumination source 102 for each option in one of three illumination states. An option that is available and not selected may be illuminated in a first illumination state, which may be a first color such as amber. An option that is available and selected may be illuminated in a second illumination state, which may be a second color such as green. An option that is unavailable may be illuminated in a third illumination state, which may be darkened or a third color such as red. A parameter sub-array 98 that is not available may be indicated by the illumination of the options switch 100 in a second illumination state, such as a darkened or off state. The options illumination sources 102 for each of the options in the parameter sub-array 98 may also be indicated by the illumination of the options illumination sources 102 in the third illumination state, such as a darkened or off state.

An example of the information communication system may be now be described with reference to FIGS. 7 and 8. The multi-variable options illumination sources 102 may take one of several states depending upon the availability and selection of an option. For example, referring to FIG. 7, the dryness temperature parameter sub-array 98 is illustrated as encompassing five different dryness temperatures: high, medium, low, extra low, and air only. These dryness temperatures are available options for one or more modes. Thus, the selection of the normal dryer mode may enable the selection of one of several dryness temperatures, for example, medium, low, extra low, and air only. Each of these dryer temperatures may be available for selection until the dryer cycle is started. The availability of these dryer temperatures may be indicated by a first illumination state, such as a blanking or strobing illumination, or a first color, such as amber. The dryer temperature that may be selected may be indicated by a second illumination state, such as a continuous illumination, or a second color, such as green. A dryer temperature that may be unavailable for the particular mode selected may be indicated by a third illumination state, such as a darkened indicator or a third color, such as red.

Figure 7:
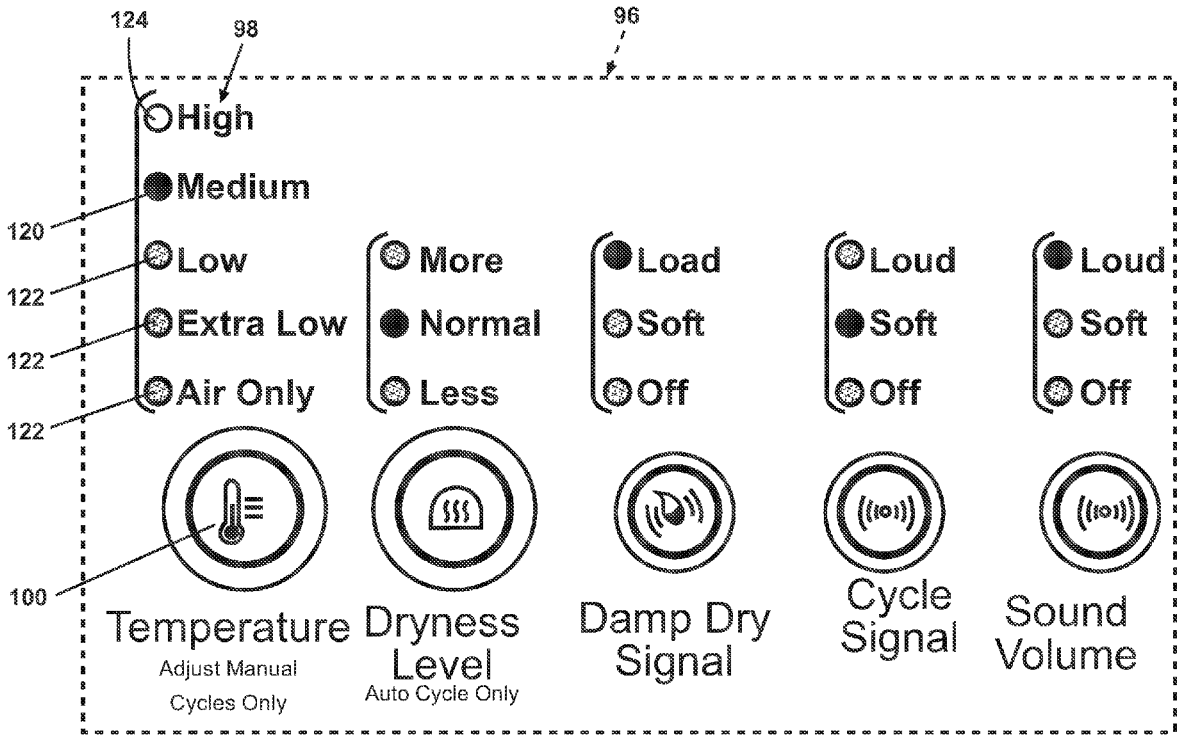
FIG. 7 is an enlarged view of a portion of the control panel illustrated in FIG. 5 showing available selected, available non-selected, and unavailable options for a plurality of parameter sub-arrays in a first configuration.

Thus, as illustrated in FIG. 7, the dryer temperature parameter sub-array 98 includes non-selected available indicators 122 illuminated in a first illumination state which indicates that the associated dryer temperatures low, extra low, and air only are available for the selected mode, but have not, in fact, been selected. The dryer temperature parameter sub-array 98 also includes the selected available indicator 120 which indicates that the medium dryer temperature may be available for the selected mode and has, in fact, been selected. The dryer temperature parameter sub-array 98 also includes the unavailable indicator 124 which indicates that the high dryer temperature may be unavailable for the selected mode.

Figure 8:
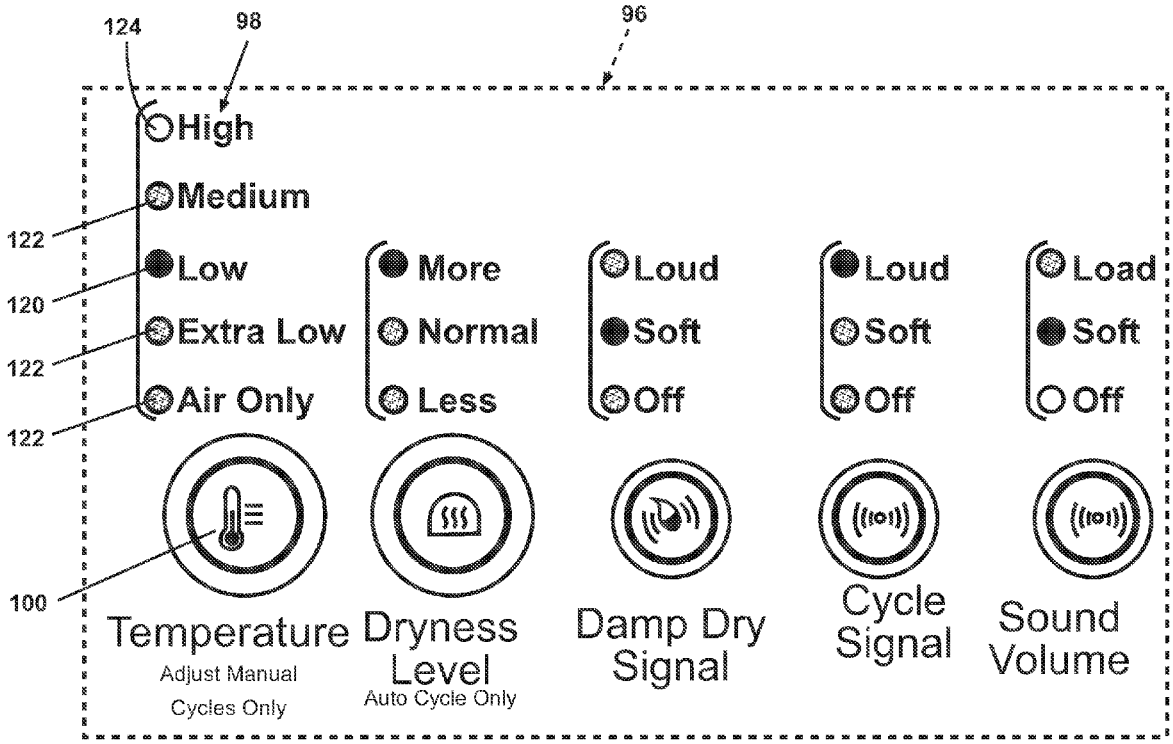
FIG. 8 is an enlarged view similar to FIG. 7 showing available selected, available non-selected, and unavailable options in a second configuration.

Referring now to FIG. 8, if a different dryer temperature, such as low, may be selected, the indicator associated with the low temperature may be illuminated 120 to indicate that low may be available and selected. The remaining dryer temperatures medium, extra low, and air only are illuminated 122 to indicate that these temperatures are available but non-selected. The high dryer temperature may be illuminated 124 to indicate that this temperature may be unavailable.

The options associated with a particular parameter sub-array 98, such as dryness level, may remain available for selection until a predetermined point in the dryer cycle, such as 80% dry, 50% dry, and the like, or after a predetermined elapsed time. Thus, the dryness level may be changed for a period of time after initiation of the dryer cycle. The multi-variable options illumination sources 102 may remain illuminated until the predetermined point in the dryer cycle has been reached to indicate that the options remains selectable. After the predetermined point has been reached, however, the available non-selected illumination sources may be darkened or illuminated in some alternative state to indicate that these options are unavailable and non-selected. The illumination of the available selected dryness option may remain unchanged. As with washers, there may be options that cannot be selected while the dryer is operating. In these instances, the available non-selected options may be illuminated to indicate that they are not available while the machine is operating, but may be illuminated as available and non-selected when the operation of the appliance is abnormally stopped, such as paused or interrupted.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A user interface for an appliance comprising:

a cycle selector comprising a plurality of operating cycles of an appliance with a corresponding cycle indicator for indicating which of the operating cycles is selected;

an option selector comprising a plurality of options for the plurality of operating cycles of an appliance with a corresponding option indicator for indicating a status of the option; and a controller operably coupled to the cycle selector and the option selector wherein the controller activates the cycle indicator corresponding to a selected operating cycle of an appliance, activates in a first activation state the option indicator for each available and selected option associated with the selected operating cycle, activates in a second activation state the option indicator for each available and non-selected option associated with the selected operating cycle, and maintains the activation of the available and non-selected options after selection of the available and selected options.

2. The user interface of claim 1 wherein at least one of the option indicator and the cycle indicator comprises a visual indicator.

3. The user interface of claim 2 wherein the option indicator comprises a visual indicator for at least some of the plurality of options.

4. The user interface of claim 3 wherein the visual indicator comprises an illumination source operable in multiple illumination states corresponding to the activation states.

5. The user interface of claim 4 wherein the multiple illumination states comprises a first illumination state corresponding to the selected available options and the second illumination states corresponding to the non-selected available options.

6. The user interface of claim 4 wherein the multiple illumination states comprises a third illumination state corresponding to an unavailable option.

7. The user interface of claim 6 wherein the first, second and third illumination states differ in at least one of color and intensity produced by the illumination source.

8. The user interface of claim 1 wherein the first and second activation states comprise the visual indicator differing in at least one of color and intensity.

9. The user interface of claim 1 wherein the controller is configured to maintain the second activation state for the option indicator for the non-selected available options until the operating cycle progresses to a point beyond which the non-selected available option can be implemented.

10. The user interface of claim 9 wherein the controller is configured to maintain the first activation state for the option indicator for the selected available options until at least the completion of the operating cycle.

11. The user interface of claim 1 wherein the controller is configured to activate the option indicator to indicate the available options after the abnormal stopping of the operational cycle.

12. A method of communicating to a user of an appliance operational information related to an operational cycle of the appliance through a user interface, comprising:

indicating options available for selection by the user for an operating cycle of the appliance;

indicating which of the available options is selected by the user;

distinguishing between the selected available options and the non-selected available options;

continuing to indicate the non-selected available options subsequent to the selection of the selected available option;

continuing to indicate the non-selected available options after the initiation of the operating cycle; and continuing to indicate the non-selected available options until the operating cycle progresses to a point beyond which the non-selected available option can be implemented.

13. The method of claim 12 wherein the indicating of available options comprises visually indicating the available options.

14. The method of claim 13 wherein the distinguishing between the selected available options and the non-selected available options comprises visually distinguishing between the selected available options and the non-selected available options.

15. The method of claim 14 wherein visually distinguishing between the selected available option and the non-selected available options comprises illuminating the selected available options in a first illumination state and illuminating the non-selected available options in a second illumination state different from the first illumination state.

16. The method of claim 15 wherein the first and second illumination states differ in at least one of color and intensity.

17. The method of claim 16 wherein the first and second illumination states are color.

18. The method of claim 17 wherein the color indicating the non-selected available option is amber.

19. The method of claim 12 further comprising distinguishing the unavailable options from the available options.

20. The method of claim 12 wherein the indicating of the selected available options comprises indicating multiple selected available options.

21. The method of claim 12 wherein the indicating of the selected available options comprises indicating a selected parameter associated with the selected available options.

22. The method of claim 21 wherein the indicating of a selected parameter comprises indicating a selected parameter from a group of parameters.

23. The method of claim 22 wherein the group of parameters comprises a group of available parameters.

24. The method of claim 12 further comprising indicating the operating cycle selected by the user from a plurality of operating cycles.

25. The method of claim 12 wherein the indicating of available options comprises visually indicating the available options.

26. The method of claim 12 wherein the distinguishing between the selected available options and the non-selected available options comprises visually distinguishing between the selected available options and the non-selected available options.

27. The method of claim 26 wherein visually distinguishing between the selected available option and the non-selected available options comprises illuminating the selected available options in a first illumination state and illuminating the non-selected available options in a second illumination state different from the first illumination state.

28. The method of claim 27 wherein the first and second illumination states differ in at least one of color and intensity.

29. The method of claim 28 wherein the first and second illumination states are color.

30. The method of claim 12 further comprising indicating the available options after the abnormal stopping of the operational cycle.

* * * * *